US005692104A

United States Patent [19]

Chow et al.

[11] Patent Number: 5,692,104

[45] Date of Patent: Nov. 25, 1997

[54] METHOD AND APPARATUS FOR DETECTING END POINTS OF SPEECH ACTIVITY

[75] Inventors: Yen-Lu Chow, Saratoga; Erik P. Staats, Brookdale, both of Calif.

[73] Assignee: Apple Computer, Inc., Cupertino, Calif.

[21] Appl. No.: 313,430

[22] Filed: Sep. 27, 1994

Related U.S. Application Data

[63] Continuation-in-part of Ser. No. 999,128, Dec. 31, 1992, Pat. No. 5,596,680.

[51] Int. Cl.[6] ..... G10L 5/06

[52] U.S. Cl. ..... 395/2.62; 395/2.57; 395/2.59; 395/2.64

[58] Field of Search ..... 395/2, 2.25, 2.26, 395/2.62, 2.57, 2.09, 2.59, 2.64, 2.22, 2.31, 2.5, 2.54; 381/31–43

[56] References Cited

U.S. PATENT DOCUMENTS

| | | | |
|---|---|---|---|
| 4,310,721 | 1/1982 | Manley et al. | 179/1 |
| 4,783,804 | 11/1988 | Juang et al. | 381/43 |
| 4,821,325 | 4/1989 | Martin et al. | 381/46 |
| 4,860,355 | 8/1989 | Copperi | 381/36 |
| 4,945,566 | 7/1990 | Mergel et al. | 381/41 |
| 5,056,150 | 10/1991 | Yu et al. | 381/43 |
| 5,091,948 | 2/1992 | Kametani | 381/42 |
| 5,241,619 | 8/1993 | Schwartz et al. | 395/2 |

OTHER PUBLICATIONS

Markel, J.D. and Gray, Jr., A.H., "Linear Production of Speech," Springer, Berlin Herdelberg New York, 1976.

Rabine, L., Sondhi, M. and Levison, S., "Note on the Properties of a Vector Quantizer for LPC Coefficients," BSTJ, vol. 62, No. 8, Oct. 1983, pp. 2603–2615.

Linde, Y., Buzo, A., and Gray, R.M., "An Algorithm for Vector Quantizer Design," IEEE Trans. Commun., COM–28, No. 1 (Jan. 1980) pp. 84–95.

Bahl, L.R., et al., "Large Vocabulary National Language Continuous Speech Recognition," Proceeding of the IEEE CASSP 1989, Glasgow.

Gray, R.M., "Vector Quantization", IEEE ASSP Magazine, Apr. 1984, vol. 1, No. 2, pp. 4–29.

Bahl, L.R., Baker, J.L., Cohen, P.S., Jelineck, F., Lewis, B.L., Mercer, R.L., "Recognition of a Continuously Read Natural Corpus" IEEE Int. Conf. on Acoustics Speech and Signal Processing, Apr. 1978.

Schwartz, R., Chow, Yl, Kimball, O., Rousos, S., Krasner, M., Makhoul, J., "Context–Dependent Modeling for Acoustic–Phonetic Recognition of Continuous Speech," IEEE Int. Conf. on Acoustics Speech and Signal Processing, Apr. 1985.

Schwartz, R.M., Chow, X.L., Roucos, S., Krauser, M., Makhoul, J., "Improved Hidden Markov Modeling of Phonemes for Continuous Speech Recognition," IEEE Int. Conf. on Acoustics, Speech and Signal Processing, Apr. 1984.

(List continued on next page.)

*Primary Examiner*—Allen R. MacDonald
*Assistant Examiner*—Richemond Dorvil
*Attorney, Agent, or Firm*—Blakely, Sokoloff, Taylor & Zafman

[57] ABSTRACT

A method and apparatus for detecting end points of speech activity in an input signal using spectral representation vectors performs beginning point detection using spectral representation vectors for the spectrum of each sample of the input signal and a spectral representation vector for the steady state portion of the input signal. The beginning point of speech is detected when the spectrum diverges from the steady state portion of the input signal. Once the beginning point has been detected, the spectral representation vectors of the input signal are used to determine the ending point of the sound in the signal. The ending point of speech is detected when the spectrum converges towards the steady state portion of the input signal. After both the beginning and ending of the sound are detected, vector quantization distortion can be used to classify the sound as speech or noise.

28 Claims, 7 Drawing Sheets

OTHER PUBLICATIONS

Alleva, F. Hon, H., Huang, X., Hwang, M., Rosenfeld, R., Weide, R., "Applying Sphinx II to DARPA Wall Street Journal CSR Task", Proc. of the DARPA Speech and NL Workshop, Feb. 1992, Morgan Kaufman Pub., San Mateo, CA.

Kai–Fu Lee, "Automatic Speech Recognition," Kluwer Academic Publishers Boston/Dordrecht/London 1989.

Dermatas, et al., "Fast Endpoint Detection Algorithm For Isolated Word Recognition In Office Environment", IEEE, May 1991, pp. 733–736.

J. Taboada, et al., "Explicit Estimation of Speech Boundaries", IEEE, May 1991, pp. 153–159.

METHOD AND APPARATUS FOR DETECTING END POINTS OF SPEECH ACTIVITY

This application is a continuation-in-part application of U.S. patent application Ser. No. 07/999,128, entitled "Method and Apparatus for Detecting Speech Activity", filed Dec. 31, 1992, U.S. Pat. No. 5,596,680, and assigned to the corporate assignee of the present invention.

FIELD OF THE INVENTION

The present invention relates to the field of continuous speech recognition; more particularly, the present invention relates to detecting speech activity.

BACKGROUND OF THE INVENTION

Recently, speech recognition systems have become more prevalent in today's high-technology market. Due to advances in computer technology and advances in speech recognition algorithms, these speech recognition systems have become more powerful.

Fundamental to all speech recognition systems is the manner in which the speech signal is represented. The speech signals are often represented according to their characteristics. When characterizing a speech signal, typically a short-term analysis approach is utilized in which a window, or frame (that is, a short time interval), is isolated for spectral analysis. By using the short time analysis approach, speech can be analyzed on a time-varying basis.

One of the simplest representations of a signal which may be used to analyze a signal on a time-varying basis is its power. Power is the energy contained in a speech waveform. Power provides a good measure for separating voiced speech segments (that is, segments of speech generated by vibration of the vocal cords) from unvoiced speech segments (that is, segments of speech generated by forcing air through a constriction in the vocal tract, or building up and quickly releasing pressure in the vocal tract). Usually, the energy for unvoiced segments is much smaller than for voiced segments. For very high quality speech, the power can be used to separate unvoiced speech from silence.

Another time domain analysis method is based on zero crossing measurements. For digitized speech signals, a zero crossing occurs between consecutive samples when the signs of the samples are different. Zero crossings are often used as an estimate of the frequency content of a speech signal. However, the interpretation of the zero crossings as applied to speech is much less precise due to the broad frequency spectrum of most sound signals. Zero crossings are also often used in making a decision about whether a particular segment of speech is voiced or unvoiced. If the zero crossing rate is high, the implication is that the segment is unvoiced, while if the zero crossing rate is low, the segment is most likely to be voiced.

Although speech is often analyzed as a time varying process, speech is also viewed on a short-time basis as the convolution of the excitation and vocal tract components associated with speech. A variety of useful techniques exist for integrating the convolution function into speech analysis. These techniques include representing the input speech with spectral representation vectors, such as raw spectrum (Fourier Transform), autocorrelation, and cepstrum. One well-known spectral representation technique is referred to as linear predictive coding (LPC). For more information on LPC, refer to Markel, J. D. and Gray, Jr., A. H., "Linear Production of Speech," Springer, Berlin Herdelberg New York, 1976.

A variety of types of speech recognition systems are in use today. One such type is commonly referred to as a continuous, or connected, speech recognition system. Continuous speech recognition systems are hierarchical in that entire phrases and sentences are recognized and grouped together to form larger speech units, as opposed to the recognition of single words.

In continuous speech, in order to recognize an utterance (that is, a phrase or sentence), a determination must be made as to where the beginning and ending of each utterance is. Detection of the beginning and ending of individual phrases is usually referred to as end point detection. When the signal-to-noise ratio is high, the determination of the end points is not difficult. However, most speech recognition is not performed in environments with high signal-to-noise ratios. Therefore, weak fricatives and low-amplitude voiced sounds occurring at the end points of the utterance become difficult to detect, resulting in errors in their recognition. Most of the end point detection schemes of the prior art use some form of energy and zero crossing techniques. However, these energy and zero crossing techniques of the prior art are inadequate in dealing with noise (both transient and background).

Once the beginning and ending points of the utterances have been identified, the sound must be recognized. Currently, large numbers of words must be matched to the utterance during the recognition process. In an effort to reduce the amount of processing required, vector quantization has been used.

Vector quantization (VQ) techniques have been used to encode and decode speech signals for the purpose of data bandwidth compression. More specifically, in speech recognition systems, vector quantization has been used for preprocessing of speech data as a means for obtaining compact descriptors through the use of a relatively sparse set of codebook vectors to represent large dynamic floating point vector elements. For more information on vector quantization, see Gray., R. M., "Vector Quantization", IEEE ASSP Magazine, April 1984, Vol. 1, No. 2. Once the data has been quantized, a recognition algorithm is used to perform the matching.

As will be shown, the present invention provides a method and apparatus for performing speech activity end point detection.

SUMMARY OF THE INVENTION

It is an object of the invention to produce a high performance speech activity detection module.

It is another object of the invention to produce a speech activity detection system that discriminates between silence and sound.

It is yet another object of the invention to produce a speech activity detection system that discriminates between speech and noises.

It is still another object of the invention to produce a speech activity detection system that reduces computation in the recognition system.

These and other objects of the present invention are provided by a method and apparatus for detecting end points of speech activity. The present invention includes a method and apparatus for generating a spectral representation vector for the spectrum of each sample of the input signal. The present invention also provides a method and apparatus for generating a spectral representation vector for the steady state portion of the input signal. The present invention provides a method and apparatus for comparing the spectral representation vector of each sample with the spectral representation vector for the steady state portion of the input signal, such that an end point of speech is located where the spectrum either diverges from or converges towards the steady state portion of the input signal.

These and other objects of the present invention are also provided by a method and apparatus for comparing the current spectral representation vector with a speech codebook and a noise codebook, wherein the sound is classified as speech or noise according to the distortion between the current spectral representation vector and the speech codebook and the noise codebook.

BRIEF DESCRIPTION OF DRAWINGS

The present invention will be understood more fully from the detailed description given below and from the accompanying drawings, which should not be taken to limit the invention to a specific embodiment but are for explanation and understanding only.

DETAILED DESCRIPTION OF THE INVENTION

Figure 1:
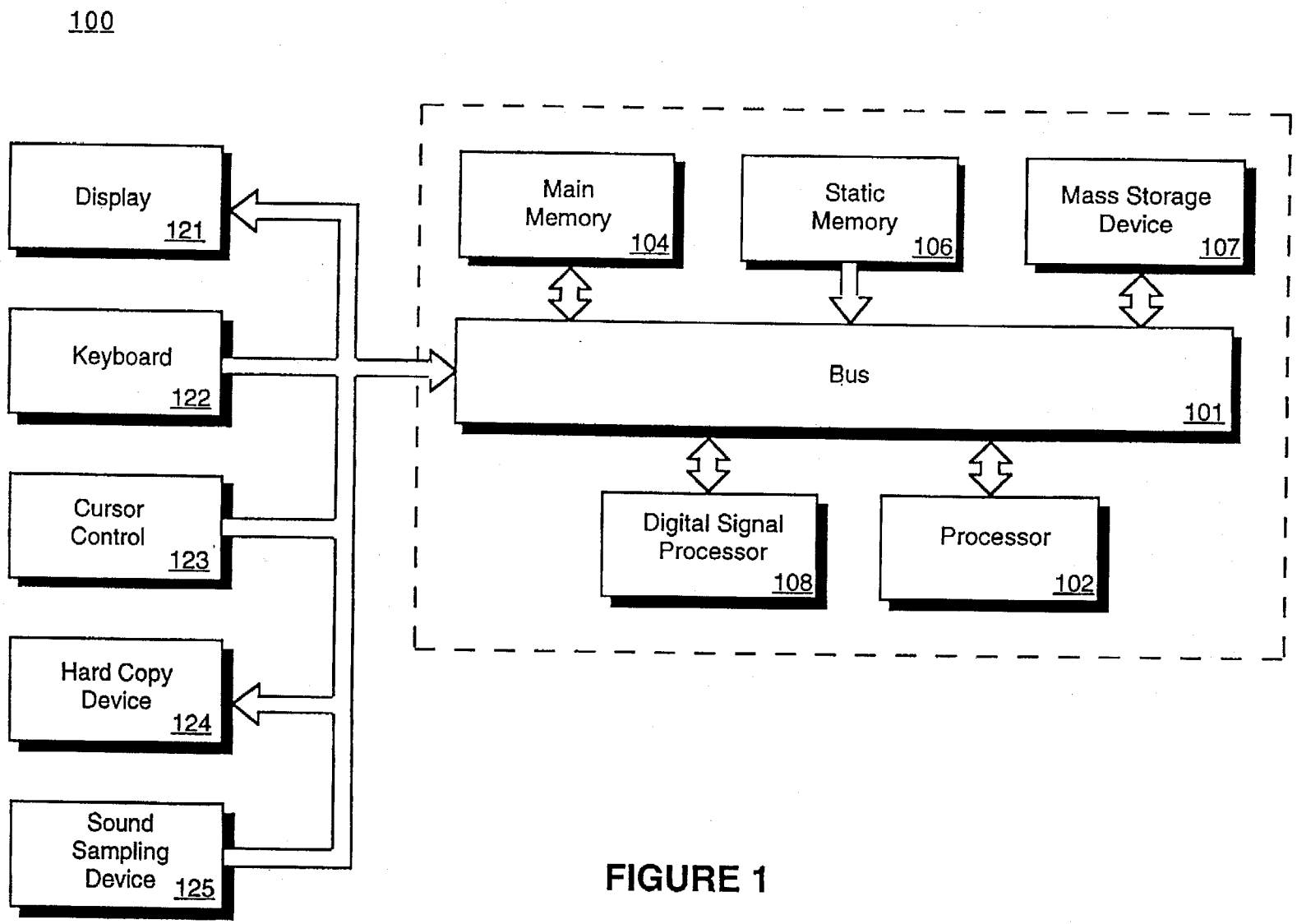
FIG. 1 is a block diagram of a computer system of one embodiment of the present invention.

A method and apparatus for performing speech activity end point detection are described. In the following description, numerous specific details are set forth such as specific processing steps, recognition algorithms, acoustic models, etc., in order to provide a thorough understanding of the present invention. It will be understood by those skilled in the art, however, that the present invention may be practiced without these specific details. In other instances, well-known speech recognition processing steps and circuitry have not been described in detail to avoid obscuring the present invention.

Some portions of the detailed descriptions which follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, vectors, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present invention, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to an apparatus for performing the method of the present invention. This apparatus may be specially constructed for the required purposes, or it may comprise a general purpose computer selectively activated or reconfigured by a computer program stored in the computer. The algorithms and displays presented herein are not inherently related to any particular computer or other apparatus. Various general purpose machines may be used with programs in accordance with the teachings herein, or it may prove convenient to construct more specialized apparatus to perform the required method steps. The required structure for a variety of these machines will appear from the description below. In addition, the present invention is not described with reference to any particular programming language. It will be appreciated that a variety of programming languages may be used to implement the teachings of the invention as described herein.

The Overview of a Computer System in One Embodiment

The present invention may be practiced on computer systems having alternative configurations. FIG. 1 illustrates some of the basic components of such a computer system, but is not meant to be limiting nor to exclude other components or combinations of components. Referring to FIG. 1, the computer system upon which one embodiment of the present invention is implemented is shown as 100. Computer system 100 comprises a bus or other communication means 101 for communicating information and a processor 102 coupled with bus 101 for processing information. Computer system 100 further comprises a random access memory (RAM) or other dynamic storage device 104 (referred to as main memory), coupled to bus 101 for storing information and instructions to be executed by processor 102. Main memory 104 also may be used for storing temporary variables or other intermediate information during execution of instructions by processor 102. Computer system 100 also comprises a read only memory (ROM) and/or other static storage device 106, coupled to bus 101 for storing static information and instructions for processor 102, and a mass data storage device 107, such as a magnetic disk or optical disk and its corresponding disk drive. Mass storage device 107 is coupled to bus 101 for storing information and instructions.

Computer system 100 may further comprise a coprocessor or processors 108, such as a digital signal processor, for additional processing bandwidth. Computer system 100 may further be coupled to a display device 121, such as a cathode ray tube (CRT), coupled to bus 101 for displaying information to a computer user. An alphanumeric input device 122, including alphanumeric and other keys, may also be coupled to bus 101 for communicating information and command selections to processor 102. An additional user input device is cursor control 123, such as a mouse, a trackball, a trackpad, or cursor direction keys, coupled to bus 101 for communicating direction information and command selections to processor 102, and for controlling cursor movement on display 121. Another device which may be coupled to bus 101 is hard copy device 124 which may be used for printing instructions, data, or other information on a medium such as paper, film, or similar types of media. System 100 may further be coupled to a sound sampling device 125 for digitizing sound signals and transmitting such digitized signals to processor 102 or digital signal processor 108 via bus 101. In this manner, sounds may be digitized and then recognized using processor 108 or 102. In one embodiment, sound sampling device 125 includes a sound transducer (microphone or receiver) and an analog-to-digital converter.

In one embodiment of the present invention, system 100 is one of the Macintosh® brand family of personal computers available from Apple Computer, Inc. of Cupertino, Calif., such as various versions of the Macintosh® II, Quadra™, PowerBook®, etc. (Macintosh®, Apple® and PowerBook® are registered trademarks of Apple Computer, Inc.). Processor 102 is one of the Motorola 680×0 family of processors available from Motorola, Inc. of Schaumburg, Ill., such as the 68020, 68030, or 68040. Alternatively, processor 102 may be a PowerPC processor. Processor 108, in one embodiment, comprises one of the AT&T DSP 3210 series of digital signal processors available from American Telephone and Telegraph (AT&T) Microelectronics of Allentown, Pa. System 100, in one embodiment, runs the Macintosh® brand operating system, also available from Apple Computer, Inc. of Cupertino, Calif.

Functional Overview of the Speech Recognition System

Figure 2:
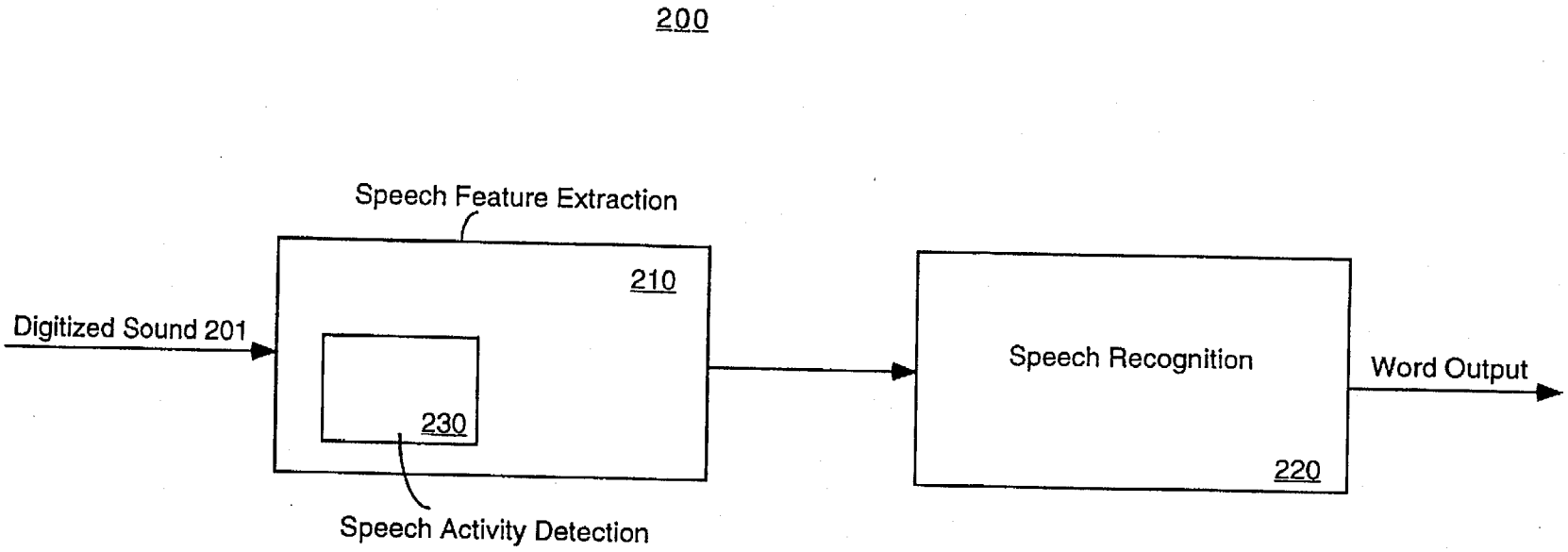
FIG. 2 is a block diagram of the speech recognition system of one embodiment of the present invention.

In one embodiment of the present invention, the system is implemented as a series of software routines that are run by processor 102, which interacts with data received from digital signal processor 108 via sound sampling device 125. It will be appreciated by one skilled in the art, however, that in an alternative embodiment, the present invention may be implemented in discrete hardware or firmware. One embodiment of the present invention is represented in the functional block diagram of FIG. 2 as 200. Digitized sound signals 201 are received from a sound sampling device such as 125 shown in FIG. 1, and are input to a circuit for speech feature extraction 210 which is otherwise known as the "front end" of the speech recognition system. The speech feature extraction process 210 is performed, in one embodiment, by digital signal processor 108. This feature extraction process 210 recognizes acoustic features of human speech, as distinguished from other sound signal information contained in digitized sound signals 201. In this manner, features such as phones or other discrete spoken speech units may be extracted, and analyzed to determine whether words are being spoken. Spurious noises such as background noises and user noises other than speech are ignored.

In one embodiment of the present invention, speech feature extraction 210 uses a method of speech encoding known as linear predictive coding (LPC). LPC is a filter parameter extraction scheme which yields roughly equivalent time or frequency domain parameters. In other words, the LPC parameters represent a time varying model of the formats or resonances of the vocal tract (without pitch).

In one embodiment, once the acoustic voice signal is digitized, the signal is converted into segmented blocks of data, each block overlapping the adjacent blocks by 50%. Then windowing is applied to create a window, commonly of the Hamming type, to each block for the purpose of controlling spectral leakage. In one embodiment, the output is processed by an LPC unit that extracts the LPC coefficients $\{a_k\}$ that are descriptive of the vocal tract format all pole filter. The LPC unit has not been shown to avoid unnecessarily obscuring the present invention.

Then spectral representation processing is performed which transforms the LPC coefficient parameter $\{a_k\}$ to a set of informationally equivalent spectral representation coefficients. The result of the transformation is the output of the speech feature extraction process 210 and comprises a spectral representation data vector, $S=[s_1\ s_2 \ldots s_p]$. Note that although an LPC spectral representation is discussed, other spectral representations, such as a Fast Fourier Transform (FFT) spectral representation, may also be utilized in conjunction with the present invention.

In one embodiment of the present invention, the spectral representation data vector is a five coefficient autocorrelation vector. The autocorrelation vector is generated by taking the autocorrelation of the windowed samples. Thus, the LPC coefficient parameter $\{a_k\}$ does not need to be generated in this embodiment. In this embodiment, the five coefficient autocorrelation vector is the output of the speech feature extraction process 210. The autocorrelation function is well-known to those skilled in the art, and thus will not be discussed further.

The acoustic features from the speech feature extraction process 210 are input to a recognizer process 220 which performs speech recognition using a language model to determine whether the extracted features represent expected words in a vocabulary recognizable by the speech recognition system. In one embodiment, recognition process 220 uses a recognition algorithm to compare a sequence of frames produced by an utterance with a sequence of nodes contained in the acoustic model of each word in the active vocabulary to determine if a match exists. The result of the recognition matching process is either a textual output or an action taken by the computer system which corresponds to the recognized word. In one embodiment of the present invention, the speech recognition algorithm employed is the Hidden Markov Model (HMM).

In one embodiment of the present invention, the speech feature extraction process 210 produces a set of spectral representation data vectors, each of which is applied to a vector quantizer. In one implementation of the present invention, these spectral representation data vectors are autocorrelation vectors. The result of the vector quantization of the spectral representation data vectors is a set of quantized spectral representation vectors. These quantized spectral representation data vectors are then quantized in and used by speech recognition 220 to produce the word output of the recognized word.

The speech activity detection block 230 in the speech feature extraction block 210 detects speech activity for the present invention. The speech detection performed by block 230 uses an adaptive spectral representation technique. Speech activity detection block 230 also discriminates between silence and sound, as well as discriminates between speech and noises, such as beeps, clicks, phone rings, etc. Furthermore, speech activity detection block 230 of the present invention reduces computation that typically must be performed by the recognition system.

Speech Activity Detection in the Present Invention

Figure 3:
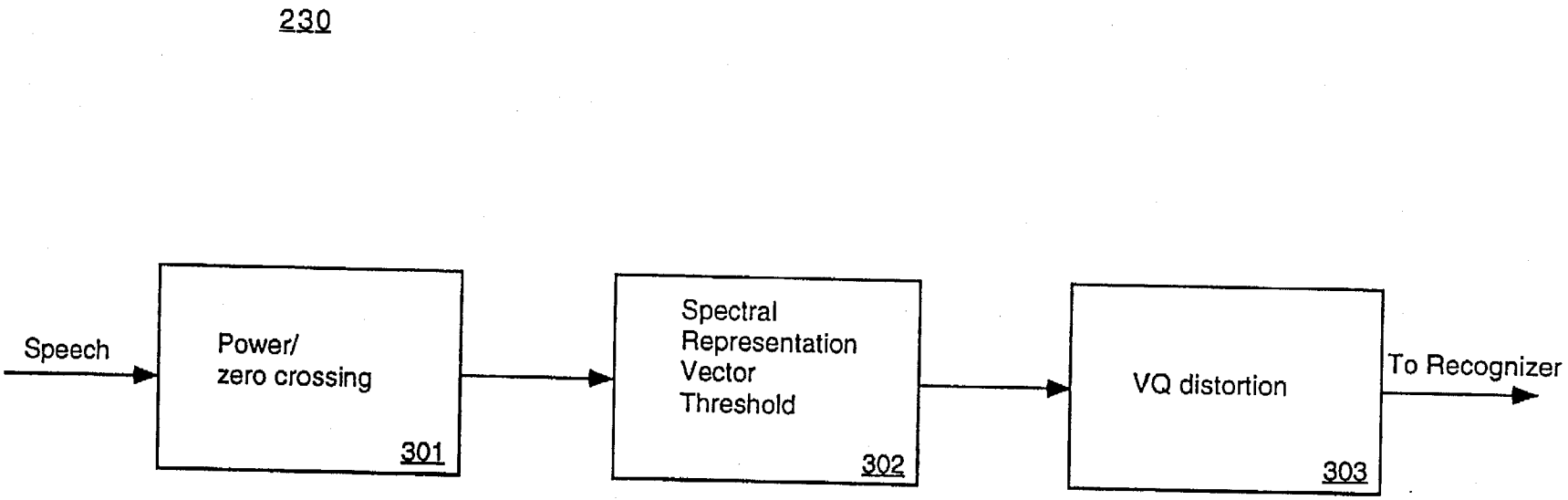
FIG. 3 is a block diagram of the speech activity detection processing of one embodiment of the present invention.

In one embodiment, the present invention utilizes a multi-stage approach to detecting speech end points. FIG. 3 depicts one embodiment of the speech activity detection block (block 230 of FIG. 2), which uses three stages to detect speech activity for an input acoustic signal. Referring to FIG. 3, the three stages of the speech activity detection block are shown as power/zero crossing block 301, spectral representation vector threshold block 302 and vector quantization (VQ) distortion block 303. A sound waveform is received by the power/zero crossing processing block 301. The output of power/zero crossing block 301 is coupled to the spectral representation vector threshold processing block 302. The output of the spectral representation vector threshold processing block 302 is coupled to the input of VQ distortion processing block 303. The output of VQ distortion processing block 303 is coupled as an input to the recognizer of the speech recognition system.

In one embodiment of the present invention, spectral representation vector threshold processing block 302 detects both end points of speech in an input sound waveform. In this embodiment, power/zero crossing block 301 performs no detection of speech in the sound waveform. In an alternate embodiment, power/zero crossing processing block 301 detects the beginning point of speech in an input sound waveform and spectral representation threshold processing block 302 detects the ending point of speech in the sound waveform.

VQ distortion processing block 303 performs sound classification to determine whether the sound waveform is speech or noise. In other words, VQ distortion processing block 303 discriminates between speech and noise in the sound waveform. If VQ distortion processing block 303 determines that the sound waveform represents speech, then the sound waveform, in its processed state, is permitted to proceed to the speech recognition stage. 0n the other hand, if VQ distortion processing block 303 determines that the sound waveform represents noise, then the sound waveform is not permitted to proceed to the speech recognition stage. Note that VQ distortion block 303 is not required for the present invention to operate correctly. In other embodiments, the function of discriminating between speech and noise could be the sole responsibility of the speech recognizer of the speech recognition system.

POWER AND ZERO CROSSINGS

In one embodiment of the present invention, power and zero crossings model voiced sounds and fricatives in order to detect the beginning point of speech in an input sound waveform. Power is the energy contained in a speech waveform. Zero crossings is a measure of the rate at which the waveform is changing. The concepts of power and zero crossing are well-known in the art. Note that power and zero crossing models are employed in one embodiment of the present invention to perform this function. However, it should be noted that other beginning point detection techniques and schemes may be employed. For instance, in an alternate embodiment the beginning point is detected using a spectral representation vector threshold technique or a vector quantization technique.

In one embodiment of the present invention, the power of the sound waveform is used to model voicing (that is, determine when a voiced sound occurs), and the zero crossing rate of the sound waveform is used to model fricatives. In other words, in one embodiment, the power is used to model voiced sounds, such as vowels "a", "e", "i", etc, while the zero crossings model the sounds which have lower energy content but are rapidly changing due to air turbulence (that is, fricatives such as "f", "s", "sh", etc.). In the present invention, it is assumed that every word contains a voice sound with the possibility of a fricative preceding the sound.

Figure 4:
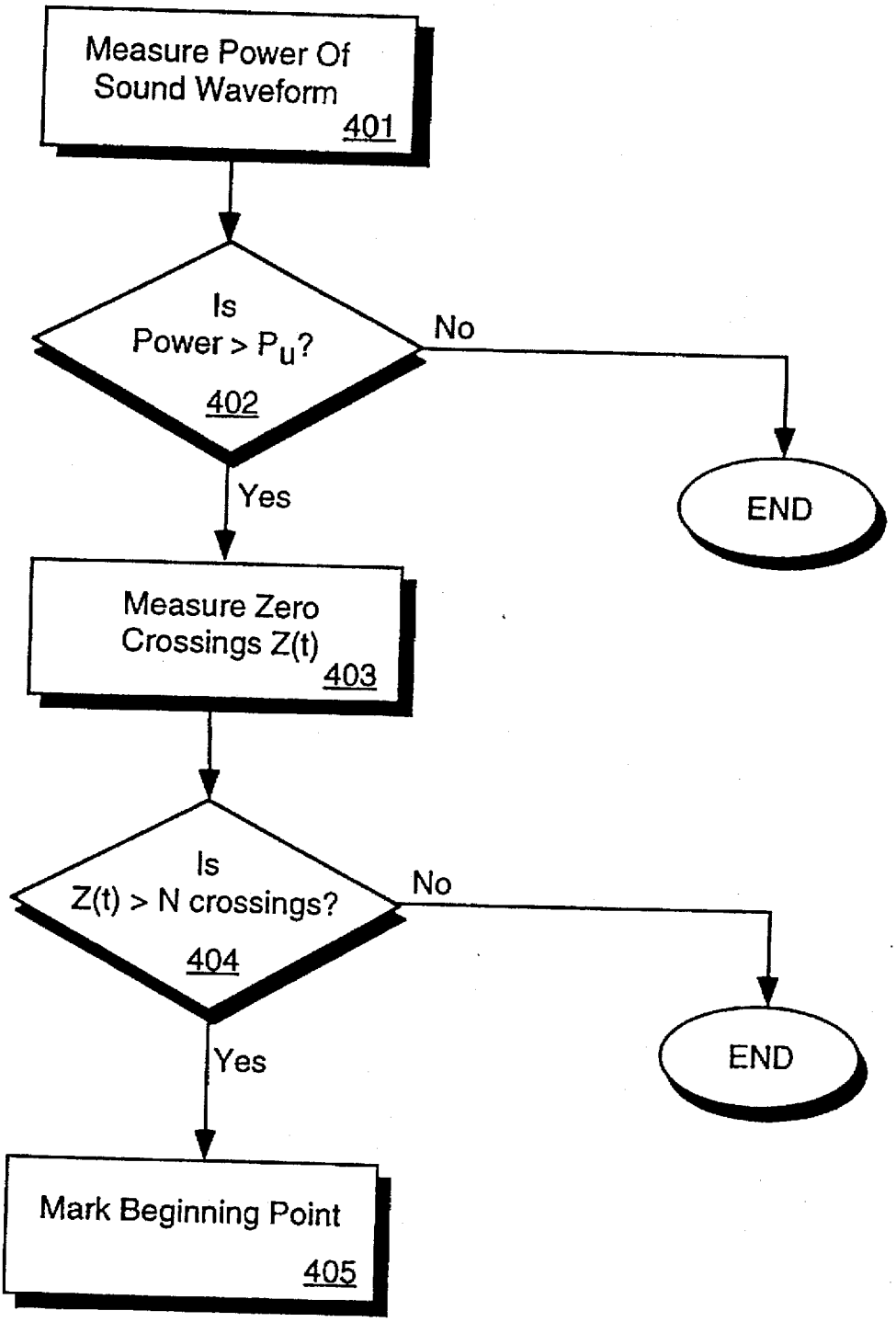
FIG. 4 is a flow chart depicting the power and zero crossing method of one embodiment of the present invention.

A flow chart of the power and zero crossings method of the present invention is shown in FIG. 4. Power/zero-crossing processing begins by finding a point in the sound waveform that exceeds an upper power threshold $P_U$ (Processing blocks 401 and 402). In one implementation, this power threshold $P_U$ is large. Once the power of the waveform exceeds the threshold $P_U$ in a predetermined number of frames, $B_s$, then voicing is assumed to exist. In one embodiment of the present invention, the power of the waveform must exceed the threshold for five frames (that is, $B_s$=5), where each of the frames is 20 milliseconds (ms) in length, in order for voicing to be considered to exist.

After the beginning of the voicing is determined, the zero crossings are used to find any low power, fricative sounds which might precede the voicing. The speech waveform is searched backwards for a maximum number of frames, $A_s$ (processing block 403). If the zero crossing rate is found to exceed a certain threshold for a predetermined number of times, N, during the maximum number frames As (processing block 404), then the first zero crossing is marked as the beginning of the speech (processing block 405). In one embodiment, the maximum number of frames $A_s$ is ten.

For finding the ending point of the speech, the power is constantly compared to a lower power threshold $P_L$. Once the power falls below the threshold $P_L$. for a predetermined number of frames, $B_e$, the end of the voicing is said to exist and that point of the sound waveform is marked as such. Next, the zero crossing rate is compared to a zero crossing threshold. If the rate exceeds the zero crossing threshold for N times in $A_e$ frames, then the end of speech is marked at the last occurrence where the zero crossing rate exceeded the threshold. In this manner, ending fricatives are modeled in the present invention.

Implementation of Power and Zero Crossings

In one embodiment, the power and zero crossing stage can be implemented to operate on either isolated utterances or large, continuous files of floating point numbers. Note that in the present invention, most of the details for either of these implementations are the same, with exceptions as noted.

In one embodiment of the present invention, to obtain the power and zero crossing rate thresholds, the first 100 ms of speech is assumed to be silence (that is, background noise). Therefore, the noise is modeled as a Gaussian (that is, the norm) by sampling the first 100 ms for its power and zero crossing rate. In this embodiment, during the first 100 ms, the window size is 2 ms in order to obtain a more accurate measure of the standard deviation.

The power is calculated by summing the absolute values of the window and dividing it by the window size. In other words, in this embodiment, power $P_n$ is calculated according to the equation:

$$P_n = \sum_{t=wn}^{w(n+1)} |s(t)|$$

where w equals the window width and n equals the frame index. This power calculation is referred to as the magnitude power calculation. Alternatively, power could be calculated using the square of the window (that is, $s^2(t)$). In this embodiment, the window width w is equal to 20 milliseconds, with the exception of during the first 100 ms (that is, during threshold determination) when the window size is 2 ms. In this embodiment, the zero crossing rate is obtained by counting only positive zero crossings and dividing by the window size. In one embodiment, zero crossings $Z_n$ are determined according to the equation:

$$Z_n = \text{Number of Positive zero crossings in the interval } [wn, w(n+1)]$$

During the first 100 ms, the number of zero crossings are determined every 2 ms and the Gaussian parameters are calculated after fifty samples are taken. In one embodiment, the norm is recalculated every 200 ms if speech has not been detected so that changes can be made to the norm if the noise level changes.

Once the thresholds have been established, the power/zero crossing processing of the present invention is performed. The present invention uses a dual threshold system to reduce false starts. In one embodiment, the magnitude version, the low power threshold ($P_L$) is the power mean plus the power standard deviation. In another embodiment, the low power threshold ($P_L$) is the power means plus 1.8 times the power standard deviation. The upper power ($P_U$) threshold is the power mean plus a predetermined number A times the power standard deviation. In one embodiment, the magnitude version, the predetermined number A is 31.0. In the squared power version, the predetermined number A is 115.0. In both versions, the zero crossing rate threshold is the zero crossing mean plus the standard deviation of the zero crossing rate.

To find the beginning point, power and zero crossing rates are calculated constantly for a pair of windows. In one embodiment, the power and zero crossing rates are calculated constantly for 20 ms non-overlapping windows. The values are stored in a circular buffer of size $A_s+B_s$ for zero crossing rate and $B_s$ for power (where $A_s$ is the maximum number of frames in which the zero crossing rate is checked to exceed a certain threshold when checking for fricative sounds and $B_s$ is the number of frames the power of the waveform must exceed the upper power threshold). In one embodiment, $A_s$ equals 10 frames and $B_s$ equals 7 frames. The zero crossing rate buffer is larger because in the present invention there is a search backwards once the beginning of the sound is found.

The power is then compared to the lower power threshold $P_L$. Once the power exceeds this point, the frame is marked as a possible beginning. Next, the power must stay above this threshold and exceed the upper threshold $P_U$. However, the power is allowed to fall below $P_L$ for a certain number of frames to allow for small bursts at the beginning of the utterance followed by a short pause. In one embodiment, the power is allowed to fall below $P_L$ for at most two frames.

Once the power exceeds the upper power threshold $P_U$, the marked frame becomes the beginning of the voicing sound. If the power falls below $P_L$ for more than two frames, the marking is removed. If the marked frame is more than $B_s$ frames before exceeding $P_U$, then the zero crossing rate is not searched because it is assumed that a long-drawn out voicing with very low power, which is representative of a glide (that is, "r" or "y") or liquid type (that is, "l" or "w") sound, has occurred. Otherwise, the zero crossing rate is searched for N crossings in $A_s$ frames. If N crossings are found, then the first crossing is marked as the fricative beginning. In one embodiment, N is 3.

Finding the ending point is symmetrical. The power must stay below $P_L$ for $B_e$ frames. In one implementation, $B_e$=7. Once the endpoint is found, the waveform is monitored for $A_e$ frames for a predetermined number of crossings. In one implementation, $A_e$=15 frames. Furthermore, in one embodiment, the number of crossings that are monitored for $A_e$ frames is three crossings. The third crossing is marked as the end of fricative, if found.

Figure 5A:
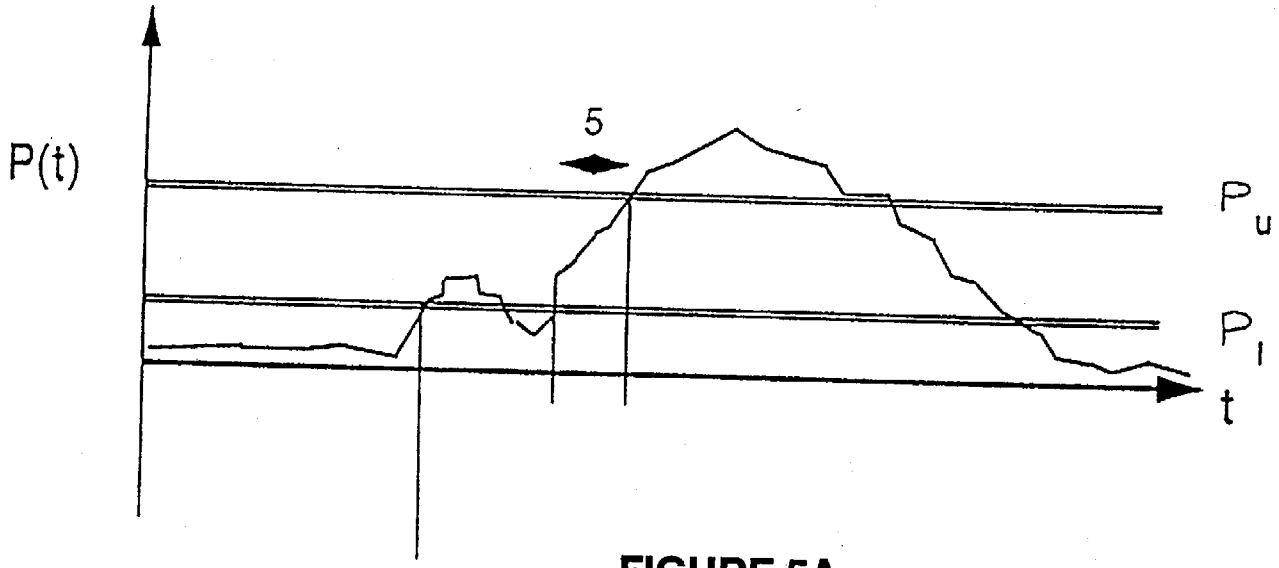
FIGS. 5A and 5B are timing diagrams illustrating the power and zero crossing of one embodiment of the present invention.
Figure 5B:
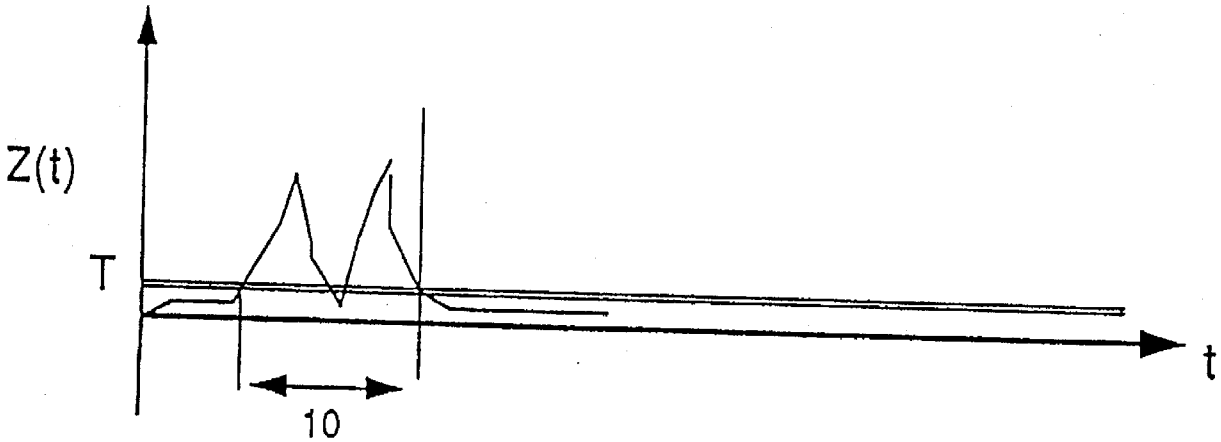

FIGS. 5A and 5B are timing diagrams that together illustrate the power and zero crossings method of the present invention. FIG. 5A is a timing diagram of the power of the speech waveform and FIG. 5B is a timing diagram of the zero crossings of the speech waveform. Therefore, the present invention employs a threshold based system, wherein when the power exceeds a particular threshold, some type of voiced sound is said to exist. Then the preceding portion of the received sound waveform is searched for regions of high zero crossing. If regions of high zero crossing exist, then the beginning region of high zero crossing is determined to be the beginning of sound.

SPECTRAL REPRESENTATION VECTOR THRESHOLD FOR END POINT DETECTION

In one embodiment of the present invention, both the beginning and ending points of speech are detected using a spectral representation vector threshold. By using the spectral representation vector threshold, the speech recognition system of the present invention is able to better deal with background noise. In the present invention, it is assumed that the speech spectrum varies rapidly while the noise spectrum remains relatively constant.

Figure 6:
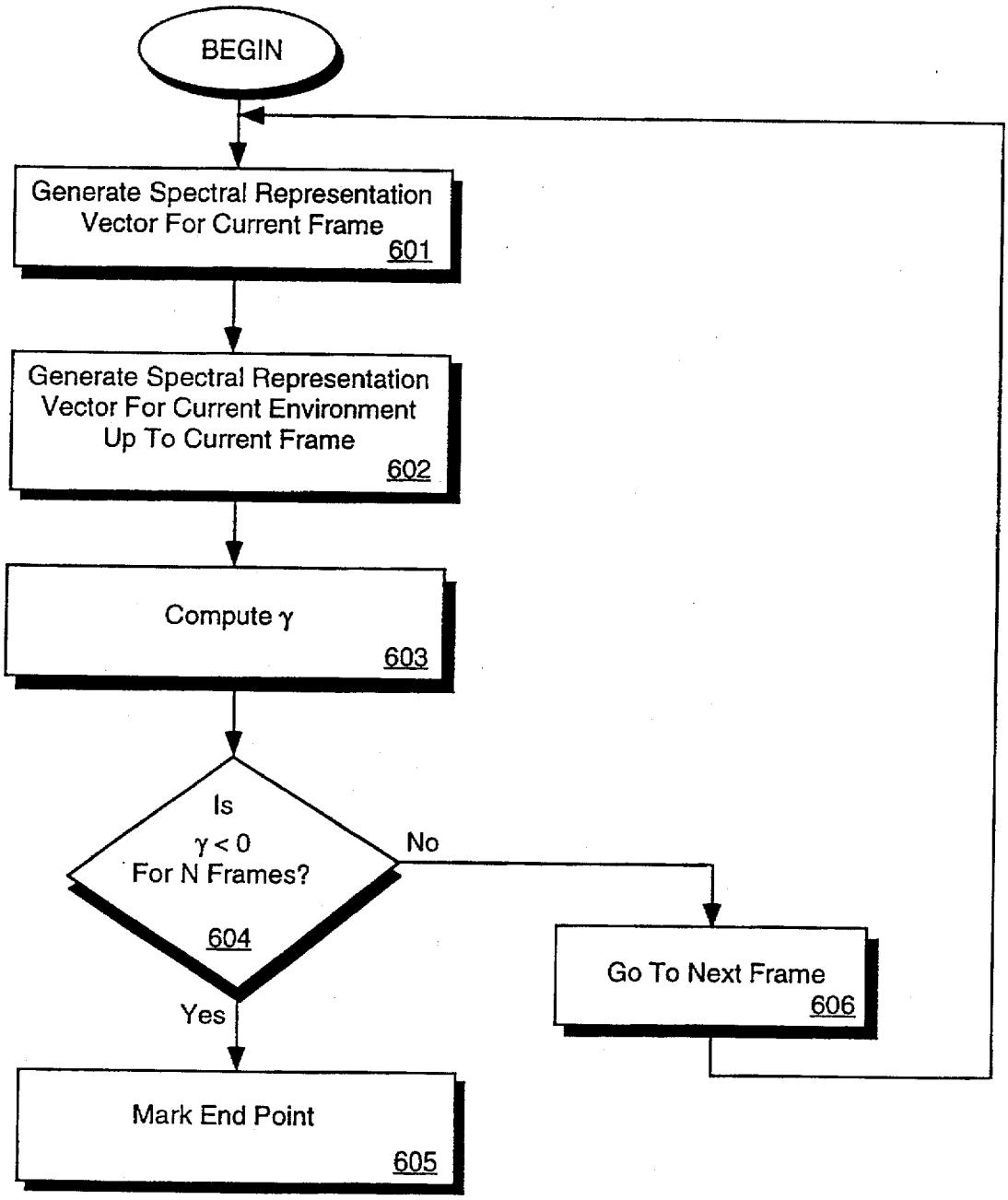
FIG. 6 is a flow chart depicting the spectral representation vector threshold process to detect end points according to one embodiment of the present invention.

The end point detection scheme of one embodiment of the present invention is shown in the flow chart of FIG. 6. In the present invention, using the spectral representation vector threshold for end point detection generally requires two steps. Referring to FIG. 6, the spectral representation vector is computed for each of the frames (that is, windows) of the input signal (processing block 601). In one embodiment, a spectral representation vector for a particular frame is computed when that frame of the input signal is received. Alternatively, a spectral representation vector may be computed for each of the frames after the entire input signal has been received.

A constant steady state portion of the input signal is also identified. The steady state portion of the input signal is the portion of the signal that remains relatively the same and does not change quickly. In one embodiment, the steady state portion of the input signal is located by finding the constant spectral representation vector (processing block 602). With the spectral representation vector computed and the constant spectral representation vector computed, the beginning point of speech is found when the spectrum begins to diverge from the steady state spectrum. Similarly, the ending point of speech is found when the spectrum begins to converge to the steady state spectrum. In one embodiment, the steady state spectrum represents the noise spectrum. In other words, when the spectrum looks like the steady state portion of the input signal, the input signal is converging to silence.

In one embodiment, the ending point is marked when the measure of speech to silence $\gamma$ (processing block 603) is less than zero for a predetermined number of frames (processing block 604). In one implementation, the ending point is marked when the measure of speech to silence $\gamma$ is less than zero for 500 consecutive frames, where each frame is 10 ms in length (processing block 605); otherwise, the process continues at the next frame (processing block 606).

Similarly, in one embodiment, the beginning point is marked when the measure of speech to silence $\gamma$ (processing block 603) is greater than zero for a predetermined number of frames (processing block 604). In one implementation, the beginning point is marked when the measure of speech to silence $\gamma$ is greater than zero for seven consecutive frames, where each frame is 10 ms in length (processing block 605); otherwise, the process continues at the next frame (processing block 606).

Implementation of Spectral Representation Vector Threshold End Point Detection The end point detection module of the present invention is a spectral representation vector-based process. In one embodiment of the present invention, the spectral representation vectors are autocorrelation vectors. When a new spectral representation vector is read in, the measure of the speech to silence is computed for the spectral representation vector. The measure corresponding to the new spectral representation vector is averaged with a predetermined number of the past average measures to produce an average measure of speech versus silence. In one embodiment, the predetermined number of past average measures used to produce an average measure of speech versus silence is three. If this average measure exceeds a speech threshold for a minimum number of frames, the beginning of speech is detected. In one embodiment of the present invention, the speech threshold is 0.1 and the minimum number of frames which the average measure must exceed the speech threshold is seven. In one embodiment, the speech threshold is chosen empirically, based on the type of spectral representation vector being used.

Once speech is detected, if the average measure remains below a silence threshold for a minimum number of frames, the end of speech is detected. In one embodiment, the silence threshold is 0.1 and the minimum number of frames which the average measure must exceed the silence threshold is 500 frames. In one embodiment, the silence threshold is chosen empirically, based on the type of spectral representation vector being used. The minimum number of frames to detect the end of speech (that is, silence) is longer in order to compensate for pauses made by the user between words within an utterance. Thus, in one embodiment of the present invention, the minimum pause length to end an utterance is five seconds.

To compute the measure of the speech versus the silence, an average spectral representation vector is computed every frame. The average spectral representation vector represents the steady state background noise. When a new spectral representation vector is read in, its distance from the average spectral representation vector is computed and used as its measure of the speech versus silence. Specifically, in one embodiment, the spectral representation vector representing the current environment up to frame n is determined according to the equation below:

$$Y_n = a\,Y_{n-1} + (1-a)X_n$$

where $X_n$ represents the current spectral representation vector of frame n and a equals 0.99. Once the spectral representation vector representing the current environment has been determined, a measurement for speech to silence $\gamma$ is computed. The measure $\gamma$ represents the deviation or variance from the long term environment (Y), such that in the present invention speech is more likely for large variances and noise is more likely for small variances. In one embodiment, the measure $\gamma$ is determined according to the equation of the norm below:

$$\gamma = \| Y_{n-1} - X_n \|^2 - \theta_e$$

where the ending point threshold $\theta_e$ is the silence threshold and is 0.1 in one embodiment. Thus, in one embodiment, the spectral representation vector norm is determined and it is compared to a threshold to determine the variance. Note that the other formulas could be used to generate a measurement $\gamma$. For instance, an absolute value measurement could be used.

Note that the average spectral representation vector is computed during speech even though the speech is not the background noise. However, the speech is not steady state, so the end point detection process of the present invention will not trigger the end of speech until the speech has actually stopped and steady state background noise spectral representations are read in. By detecting the average spectral representation vector (that is, the background or steady state) for each frame, the present invention can compensate for changes in ambient noise because each new measurement includes the current environment when determining the steady state.

It should be noted that any of a wide variety of spectral representation vectors could be used for end point detection. In one embodiment of the present invention, autocorrelation vectors are used. Alternatively, raw spectrum (Fourier Transform), cepstrum, or mel-frequency cepstrum representation vectors may be used. In addition, any other of a wide variety of spectral representation vectors could be utilized to represent the speech input within the spirit and scope of the present invention.

VECTOR QUANTIZATION (VQ) DISTORTION CLASSIFICATION OF SOUNDS

In one embodiment of the present invention, after the end point of the sound has been detected, the present invention uses vector quantization to classify the sounds as either noise or speech. By using VQ distortion, the present invention is able to compensate for transient noise. To perform the sound classification, the present invention computes the distortion between the input spectral representation vector, corresponding to a frame of the sound sampling, and two codebooks, one for speech and one for noise. A codebook is a collection of representative spectral representation vectors for the specific sound class. The use of codebooks in vector quantization is well-known in the art.

In the present invention, the codebooks are computed for each sound type to be classified. In other words, the codebooks used in classification are initially trained. In one embodiment, two codebooks are trained, one using truncated speech spectral representation vector and one using truncated noise spectral representation vector, that is, one codebook is computed for speech and one codebook is computed for noise. In one embodiment, the codebook for speech contains 256 representative spectral representation vectors and the codebook for noise contains 64 representative spectral representation vectors.

Figure 7:
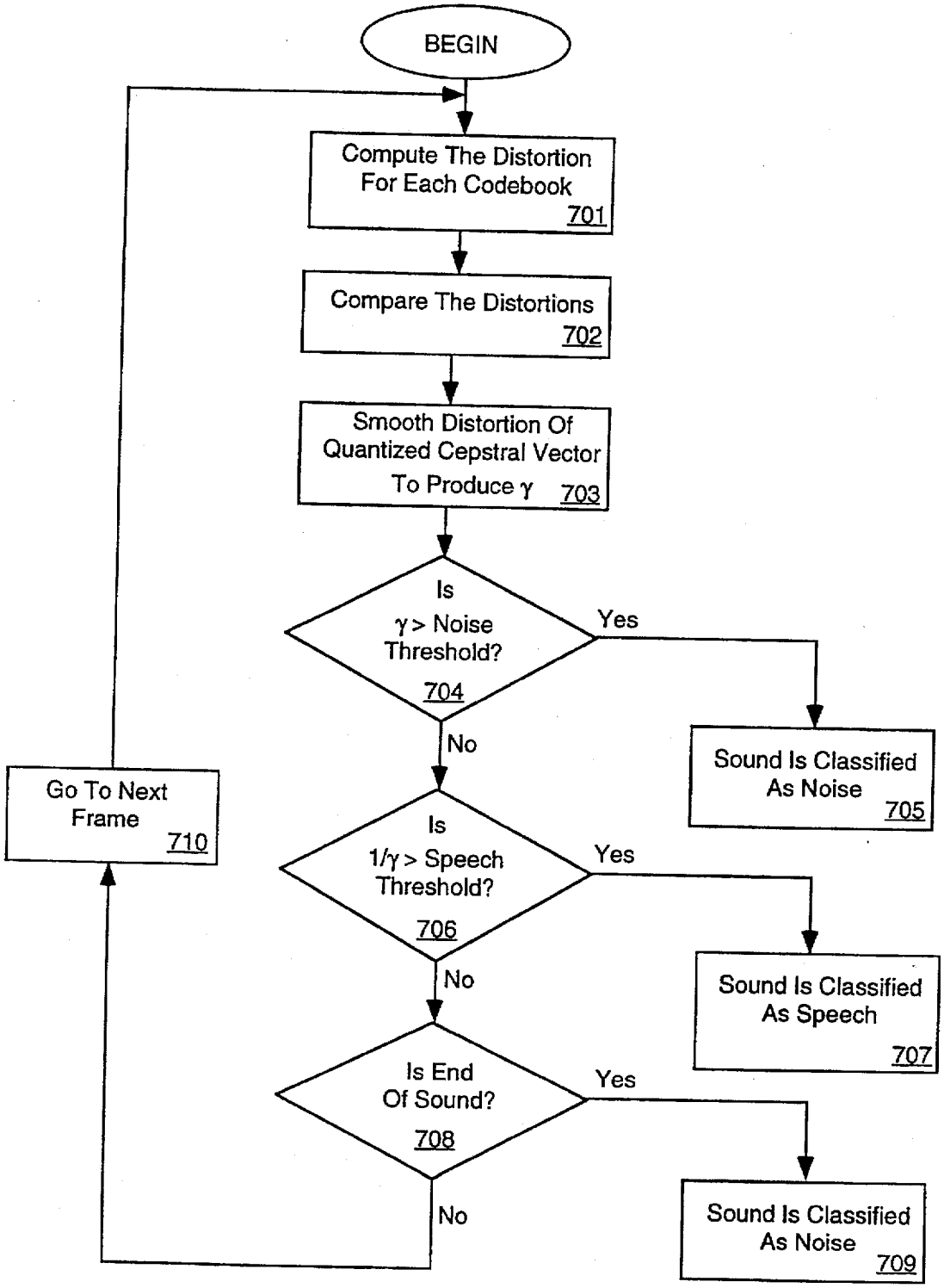
FIG. 7 is a flow chart depicting the vector quantization distortion stage of one embodiment of the present invention.

FIG. 7 is a flow chart of the vector quantization distortion stage of the present invention. In the present invention, given an input spectral representation vector X, the distortion from each of the codebooks is computed (processing block 701). In one embodiment, if the speech distortion is large and the noise distortion is small, then the sound is most likely noise. In other words, if the ratio of the distortion from the speech codebook to the distortion from the noise codebook is greater than a noise threshold, then the sound is classified as noise. On the other hand, if the noise distortion is large and the speech distortion is small, the sound is most likely speech. In other words, if the ratio of the distortion from the noise codebook to the distortion from the speech codebook is greater than a speech threshold, then the sound is classified as speech. In one embodiment, the ratios are inverses of each other. Since the ratios are inverses of each other, the thresholds used are positive values greater than one.

In one embodiment, the distortions are smoothed over a frame length of variable duration (W). The distortions are initially determined and the distortion of the quantized spectral representation vector from the two codebooks is compared as follows (processing block 702):

$$\alpha_n = \frac{\Delta_s(X_n)}{\Delta_n(X_n)}$$

where $X_n$ is the nth spectral representation vector, $\Delta_s$ is the distortion of $X_n$ when quantized by the speech codebook, and $\Delta_n$ is the distortion of $X_n$ when quantized by the noise codebook.

The distortion of the quantized spectral representation vector is smoothed according to the following equation (processing block 703):

$$\gamma = \frac{1}{W} \sum_{k=n}^{n-w+1} \alpha_k$$

where W equals the smoothing window width. In one implementation of the present invention, the smoothing window width W equals 1 frame, where each frame is 10 ms.

The distortion must exceed the same threshold N times in L smooth frames. That is, if the distortion is greater than the noise threshold at least N times for L windows (processing block 704), then the present invention classifies the sound as noise (processing block 705), and if $1/\gamma$ is greater than the speech threshold at least N times for L windows (processing block 706), then the sound is speech (processing block 707). In one implementation, the variable duration L is 8 frames, the distortion must exceed the same threshold one time (that is, N=1) over eight smooth frames (that is, L=8).

In one embodiment of the present invention, the vector quantization distortion process begins by searching the spectral representation vectors from left to right. Each distortion is smoothed and the ratio of the speech to noise distortion is stored in a circular buffer. The size of the circular buffer for storing the ratio is equal to the number of frames L. In one implementation, the size of the circular buffer for storing the ratio is 8 frames long. The speech and noise classification conditions are checked. If no decision can be made, then the present invention continues to the next frame (processing block 710). In one embodiment, no decision can be made if there are not enough crossings of either threshold or the values fall between the two thresholds. This process continues until the end of the sound is reached or a decision is made. In one embodiment, if no decision is made by the end of the sound (processing block 708), then the sound is classified as noise (processing block 709).

If the sound waveform is classified as speech, then the sound waveform, in its processed state, is permitted to proceed to the speech recognition stage. On the other hand, if the sound waveform is classified as noise, then the sound waveform is not permitted to proceed to the speech recognition stage.

It should be noted that any of a wide variety of spectral representation vectors could be used in the vector quantization distortion stage of the present invention. In one embodiment of the present invention, autocorrelation vectors are used. Alternatively, raw spectrum (Fourier Transform), cepstrum, or mel-frequency cepstrum representation vectors may be used. In addition, any other of a wide variety of spectral representation vectors could be utilized to represent the speech input within the spirit and scope of the present invention.

The multi-stage speech activity detection mechanism of the present invention provides benefits to the speech recognition system. For instance, the power and zero crossings reduce digital sound processing load from fifty percent to a load less than five percent in one embodiment. Furthermore, use of the spectral representation vector threshold provides reliable end point detection and robustness to changing ambient noise. In other words, the end point will reliably be found in "steady state" background noise, and the present invention allows for adaptability in an environment that changes its ambient noise level. Also, the VQ distortion reduces the recognition computation in significantly noisy environments with minimal loss in accuracy. The present invention provides for better environmental adaptation by adapting only to sounds classified as speech since non-steady state noise will be rejected. Therefore, if environmental adaptation algorithms are utilized, the algorithms will perform more effectively because there will be no adaptation to non-steady state noise. For more information on environmental algorithms, see Alex Acero, *BSDCN* (PHD Thesis) Carnegie Mellon University, School of Computer Science, Pittsburgh Pa. 1991.

Whereas many alterations and modifications of the present invention will no doubt become apparent to those skilled in the art after having read the foregoing description, it is to be understood that the particular embodiment shown and described by way of illustration is in no way intended to be considered limiting. Therefore, reference to the details of specific embodiments are not intended to limit the scope of the claims which themselves recite only those features regarded as essential to the invention.

Thus, a method and apparatus for detecting end points of speech activity has been described.

What is claimed is:

1. A method of detecting speech activity in a data input stream comprising the steps of:

(a) generating a set of spectral representation vectors to represent the data input stream, wherein each spectral representation vector of the set of spectral representation vectors represents a predetermined portion of the data input stream;

(b) generating a steady state spectral representation vector indicative of the state of the data input stream at a first predetermined portion of the data input stream;

(c) comparing a spectral representation vector corresponding to the first predetermined portion of the data input stream to the steady state spectral representation vector;

(d) determining a first end point of speech activity when the set of spectral representation vectors diverges from the steady state spectral representation vector; and (e) determining a second end point of speech activity when a predetermined number of spectral representation vectors of the set of spectral representation vectors are within a predetermined distance of the steady state spectral representation vector for a continuous predetermined period of time.

2. A method of detecting speech activity in a data input stream comprising the steps of:

(a) generating a set of autocorrelation vectors to represent the data input stream, wherein each autocorrelation vector of the set of autocorrelation vectors represents a predetermined portion of the data input stream;

(b) generating a steady state autocorrelation vector indicative of the state of the data input stream at a first predetermined portion of the data input stream;

(c) comparing an autocorrelation vector corresponding to the first predetermined portion of the data input stream to the steady state autocorrelation vector; and (d) determining a first end point of speech activity when the set of autocorrelation vectors diverges from the steady state autocorrelation vector.

3. The method of claim 2, further comprising the step of:

(e) determining a second point of speech activity when the set of autocorrelation vectors converges towards the steady state autocorrelation vector.

4. The method of claim 3, wherein the step (e) comprises determining the second end point of speech activity when a predetermined number of autocorrelation vectors of the set of autocorrelation vectors are within a predetermined distance of the steady state autocorrelation vector for a continuous predetermined period of time.

5. The method of claim 3, further comprising the steps of:

(f) calculating a first distortion for each of a plurality of autocorrelation vectors of the set of autocorrelation vectors between each of the plurality of autocorrelation vectors and a speech codebook;

(g) calculating a second distortion for each of a plurality of autocorrelation vectors of the set of autocorrelation vectors between each of the plurality of autocorrelation vectors and the noise codebook; and (h) classifying the speech activity as speech, provided the first distortion is greater than a speech threshold for a first predetermined period of time, otherwise classifying the speech activity as noise, provided the second distortion is greater than a noise threshold for the first predetermined period of time.

6. The method of claim 2, wherein the step (d) comprises determining the first end point of speech activity when a predetermined number of autocorrelation vectors of the set of autocorrelation vectors are a predetermined distance away from the steady state autocorrelation vector for a continuous predetermined period of time.

7. A method of detecting speech activity in a data input stream comprising the steps of:

(a) generating a set of Fourier Transform vectors to represent the data input stream, wherein each Fourier Transform vector of the set of Fourier Transform vectors represents a predetermined portion of the data input stream;

(b) generating a steady state Fourier Transform vector indicative of the state of the data input stream at a first predetermined portion of the data input stream;

(c) comparing a Fourier Transform vector corresponding to the first predetermined portion of the data input stream to the steady state Fourier Transform vector; and (d) determining a first end point of speech activity when the set of Fourier Transform vectors diverges from the steady state Fourier Transform vector.

8. The method of claim 7, further comprising the step of:

(e) determining a second end point of speech activity when the set of Fourier Transform vectors converges towards the steady state Fourier Transform vector.

9. The method of claim 8, wherein the step (e) comprises determining the second end point of speech activity when a predetermined number of Fourier Transform vectors of the set of Fourier Transform vectors are within a predetermined distance of the steady state Fourier Transform vector for a continuous predetermined period of time.

10. The method of claim 8, further comprising the steps of:

(f) calculating a first distortion for each of a plurality of Fourier Transform vectors of the set of Fourier Transform vectors between each of the plurality of Fourier Transform vectors and a speech codebook;

(g) calculating a second distortion for each of a plurality of Fourier Transform vectors of the set of Fourier Transform vectors between each of the plurality of Fourier Transform vectors and the noise codebook; and (h) classifying the speech activity as speech, provided the first distortion is greater than a speech threshold for a first predetermined period of time, otherwise classifying the speech activity as noise, provided the second distortion is greater than a noise threshold for the first predetermined period of time.

11. The method of claim 7, wherein the step (d) comprises determining the first end point of speech activity when a predetermined number of Fourier Transform vectors of the set of Fourier Transform vectors are a predetermined distance away from the steady state Fourier Transform vector for a continuous predetermined period of time.

12. An apparatus for detecting speech activity in a data input stream comprising:

a memory unit;

an input device for receiving the data input stream; and a processor coupled to the memory unit and the input device, wherein the processor generates a set of spectral representation vectors to represent the data input stream and stores the set of spectral representation vectors in the memory unit, wherein each spectral representation vector of the set of spectral representation vectors represents a predetermined portion of the data input stream, wherein the processor also generates a steady state spectral representation vector indicative of the state of the data input stream at a first predetermined portion of the data input stream and compares a spectral representation vector corresponding to the first predetermined portion of the data input stream to the steady state spectral representation vector, determines a first end point of speech activity when the set of spectral representation vectors diverges from the steady state spectral representation vector, and determines a second end point of speech activity when a predetermined number of spectral representation vectors of the set of spectral representation vectors are within a predetermined distance of the steady state spectral representation vector for a continuous predetermined period of time.

13. An apparatus for detecting speech activity in a data input stream comprising:

a memory unit;

an input device for receiving the data input stream;

a processor coupled to the memory unit and the input device, wherein the processor generates a set of autocorrelation vectors to represent the data input stream and stores the set of autocorrelation vectors in the memory unit, wherein each autocorrelation vector of the set of autocorrelation vectors represents a predetermined portion of the data input stream, wherein the processor also generates a steady state autocorrelation vector indicative of the state of the data input stream at a first predetermined portion of the data input stream and compares an autocorrelation vector corresponding to the first predetermined portion of the data input stream to the steady state autocorrelation vector, and determines a first end point of speech activity when the set of autocorrelation vectors diverges from the steady state autocorrelation vector.

14. The apparatus of claim 13, wherein the processor determines a second end point of speech activity when the set of autocorrelation vectors converges towards the steady state autocorrelation vector.

15. The apparatus of claim 14, wherein the processor also calculates a first distortion for each of a plurality of autocorrelation vectors of the set of spectral representation vectors between each of the plurality of autocorrelation vectors and a speech codebook, calculates a second distortion for each of a plurality of autocorrelation vectors of the set of autocorrelation vectors between each of the plurality of autocorrelation vectors and the noise codebook, classifies the speech activity as speech, provided the first distortion is greater than a speech threshold for a first predetermined period of time, and classifies the speech activity as noise, provided the second distortion is greater than a noise threshold for the first predetermined period of time.

16. The apparatus of claim 13, wherein the processor determines the first end point of speech activity when a predetermined number of autocorrelation vectors of the set of autocorrelation vectors are a predetermined distance away from the steady state autocorrelation vector for a continuous predetermined period of time.

17. An apparatus for detecting speech activity in a data input stream comprising:

a memory unit;

an input device for receiving the data input stream;

a processor coupled to the memory unit and the input device, wherein the processor generates a set of Fourier Transform vectors to represent the data input stream and stores the set of Fourier Transform vectors in the memory unit, wherein each Fourier Transform vector of the set of Fourier Transform vectors represents a predetermined portion of the data input stream, wherein the processor also generates a steady state Fourier Transform vector indicative of the state of the data input stream at a first predetermined portion of the data input stream and compares a Fourier Transform vector corresponding to the first predetermined portion of the data input stream to the steady state Fourier Transform vector, and determines a first end point of speech activity when the set of Fourier Transform vectors diverges from the steady state Fourier Transform vector.

18. The apparatus of claim 17, wherein the processor determines a second end point of speech activity when the set of Fourier Transform vectors converges towards the steady state Fourier Transform vector.

19. The apparatus of claim 18, wherein the processor also calculates a first distortion for each of a plurality of Fourier Transform vectors of the set of Fourier Transform vectors between each of the plurality of Fourier Transform vectors and a speech codebook, calculates a second distortion for each of a plurality of Fourier Transform vectors of the set of Fourier Transform vectors between each of the plurality of Fourier Transform vectors and the noise codebook, classifies the speech activity as speech, provided the first distortion is greater than a speech threshold for a first predetermined period of time, and classifies the speech activity as noise, provided the second distortion is greater than a noise threshold for the first predetermined period of time.

20. The apparatus of claim 17, wherein the processor determines the first end point of speech activity exists when a predetermined number of Fourier Transform vectors of the set of Fourier Transform vectors are a predetermined distance away from the steady state Fourier Transform vector for a continuous predetermined period of time.

21. A method of detecting speech activity in a data input stream comprising the steps of:

(a) generating a set of spectral representation vectors to represent a plurality of portions of the data input stream;

(b) generating a steady state spectral representation vector indicative of the state of the data input stream at a first portion of the data input stream, wherein the first portion is one of the plurality of portions;

(c) comparing a first spectral representation vector representing the first portion of the data input stream to the steady state spectral representation vector; and (d) determining a first end point of speech activity when the set of spectral representation vectors diverges from the steady state spectral representation vector.

22. The method of claim 21, further comprising the step of:

(e) determining a second end point of speech activity when the set of spectral representation vectors converges towards the steady state spectral representation vector.

23. The method of claim 22, further comprising the step of:

(f) determining whether the speech activity more closely resembles a speech codebook or a noise codebook.

24. The method of claim 21, wherein the spectral representation vectors are autocorrelation vectors.

25. An apparatus for detecting speech activity in a data input stream comprising:

a memory unit an input device for receiving the data input stream; and a processor coupled to the memory unit and the input device, wherein the processor generates a set of spectral representation vectors to represent a plurality of portions of the data input stream and stores the set of spectral representation vectors in the memory unit, wherein the processor also generates a steady state spectral representation vector indicative of the state of the data input stream at a first portion of the data input stream, wherein the first portion is one of the plurality of portions, wherein the processor also compares a first spectral representation vector representing the first portion of the data input stream to the steady state spectral representation vector and determines a first end point of speech activity when the set of spectral representation vectors diverges from the steady state spectral representation vector.

26. The apparatus of claim 25, wherein the processor also determines a second end point of speech activity when the set of spectral representation vectors converges towards the steady state spectral representation vector.

27. The apparatus of claim 26, wherein the processor also determines whether the speech activity more closely resembles a speech codebook or a noise codebook.

28. The apparatus of claim 25, wherein the spectral representation vectors are autocorrelation vectors.

* * * * *